United States Patent [19]

Luke

[11] Patent Number: 4,648,455

[45] Date of Patent: Mar. 10, 1987

[54] METHOD AND APPARATUS FOR STEAM INJECTION IN SUBTERRANEAN WELLS

[75] Inventor: Mike A. Luke, Pasadena, Tex.

[73] Assignee: Baker Oil Tools, Inc., Orange, Calif.

[21] Appl. No.: 852,571

[22] Filed: Apr. 16, 1986

[51] Int. Cl.[4] ..... E21B 43/24

[52] U.S. Cl. ..... 166/303; 166/67; 166/242; 166/269

[58] Field of Search ..... 166/269, 303, 272, 117.5, 166/316, 319, 305.1, 242, 67

[56] References Cited

U.S. PATENT DOCUMENTS

| | | | |
|---|---|---|---|
| 1,439,560 | 12/1922 | Lee | 166/303 |
| 2,227,539 | 1/1941 | Dorton | 166/269 X |
| 2,611,436 | 9/1952 | Carr et al. | 166/269 X |
| 2,973,039 | 2/1961 | Payne, Jr. | 166/269 X |
| 3,422,893 | 1/1969 | Warren | 166/303 |
| 3,455,382 | 7/1969 | Chenoweth | 166/269 X |
| 4,058,164 | 11/1977 | Stoddard et al. | 166/303 |

*Primary Examiner*—Stephen J. Novosad

*Attorney, Agent, or Firm*—Norvell & Associates

[57] ABSTRACT

Apparatus for injecting high-temperature steam at a selected mass flow rate into a plurality of vertically spaced production formations of a subterranean well comprises a plurality of choke devices connected in series relationship in a tubing string extending to the well surface. Each choke device is positioned immediately above or adjacent to a production formation and defines a flow diversion device which extracts a predetermined portion of steam flow from the main steam flow, moving downwardly through the tubing string and directs such diverted steam portion into the inlet chamber of a Venturi passage. The steam is accelerated by the Venturi passage to its critical mass flow rate and is discharged into the production formation. In a preferred embodiment of the invention, the Venturi passage is connected in series with a fluid mixing apparatus which effects an intimate mixture of vapor and water components of the steam. A Venturi passage may also be incorporated in the steam supply line connected between the source of steam and the tubing string of the particular well.

24 Claims, 6 Drawing Figures

METHOD AND APPARATUS FOR STEAM INJECTION IN SUBTERRANEAN WELLS

BACKGROUND OF THE INVENTION

1. FIELD OF THE INVENTION

The invention relates to a method and apparatus for effecting the injection of steam at a selected mass flow rate into one or more production formations traversed by a subterranean well.

2. HISTORY OF THE PRIOR ART

Injection of high-temperature steam into production formations of subterranean wells has been a common practice, particularly where the hydrocarbons contained in the production formation is highly viscous. A typical subterranean well normally traverses more than one production formation, which may be spaced apart by thousands of feet in the well. The steam injected into each production formation must obviously be at a pressure in excess of the formation pressure and at a temperature and mass flow rate high enough to effect the desired reduction in viscosity of the hydrocarbons contained in the particular production formation.

With conventional apparatus, the amount of pressure required to introduce steam at a desired flow rate and temperature to each of a plurality of vertically spaced production formations has required that the steam generator located at the surface produce steam at high pressures; and the higher the pressure, the greater the cost of the apparatus for production of such steam, and the operating cost.

This objective has not been efficiently accomplished in the prior art systems. It has been the practice when injecting steam into multiple formations to run multiple lengths of tubing string so that each string supplies steam to a separate formation. Obviously the cost of installing and operating such steam injection system is excessive. The industry needs a single tubing system for supplying selected quantities of high-pressure steam simultaneously and economically to a plurality of vertically spaced production formations in a well.

SUMMARY OF THE INVENTION

The invention provides a multiformation steam injection system utilizing a single tubing string extending from the wellhead downwardly through the various vertically spaced production formations. At each production formation a tubular housing is incorporated in series relationship in the tubing string. Such tubular housing preferably includes a fluid mixer and fluid diversion means directing a portion of the steam flow outwardly into adjacent relationship to the bore of the tubular housing. A port is provided in the wall of the tubular housing and, adjacent this port, a secondary housing is externally mounted on the tubular housing. Such external housing defines an inlet chamber communicating with the wall port in the tubular housing, and the inlet chamber in turn communicates with a Venturi-shaped passageway which discharges the steam into the adjacent production formation at a selected mass flow rate. The remaining portion of the steam continues downwardly through the bore of the tubular housing to the next tubular housing wherein the apparatus associated with the first-mentioned tubular housing is repeated and effects a selected mass flow rate discharge of steam into the next formation.

In some instances, it is desirable to retrieve the tubular housing containing the Venturi passage from the well by wireline. In accordance with a modification of this invention, internal components of the tubular housing define the Venturi passage and are retrievable by a wireline tool.

To further facilitate the efficient supply of steam to the aforedescribed steam injection system, a Venturi is incorporated in the steam line running from the steam source or boiler to the well-head. This Venturi passage is also proportioned so as to supply steam to the well head at a selected mass flow rate. Preferably, each of the other Venturi passages incorporated in the steam injection system are proportioned to discharge the steam at a mass flow rate proportioned to the heat requirements of the respective formations. With this arrangement, the steam is efficiently supplied to the various production formations with a minimum pressure drop being created by the entire system so that the pressure of the steam supplied from the boiler may be substantially reduced, thus achieving substantial economies in the cost of the steam injection system.

Further advantages of this invention will be readily apparent to those skilled in the art from the following detailed description thereof, taken in conjunction with the annexed sheets of drawings on which is shown a preferred embodiment of the invention.

DESCRIPTION OF PREFERRED EMBODIMENT

Figure 1:
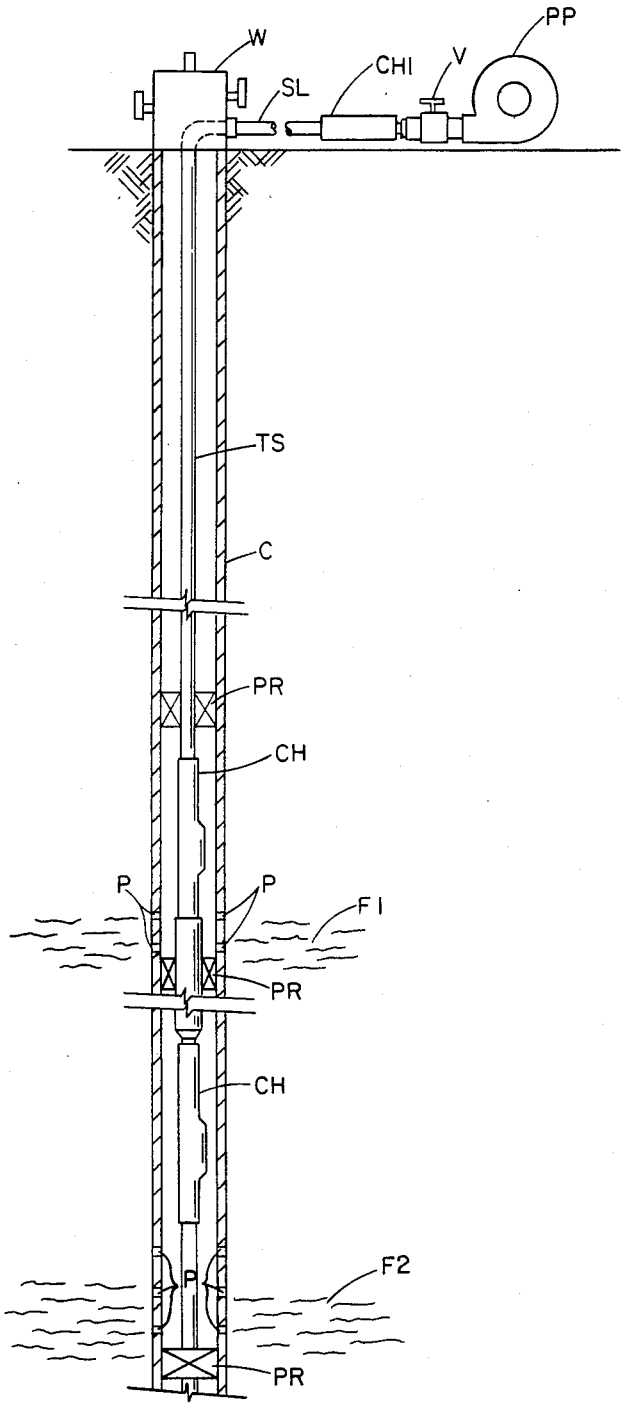
FIG. 1 is a schematic view of a steam injection system for supplying steam at selected mass flow rates to a plurality of vertically spaced production formations traversed by a subterranean well.

Referring now to the schematic view of FIG. 1, the well casing C of a subterranean well passes through a plurality of vertically spaced production formations F1 and F2 and the casing is provided with perforations P adjacent such production formations. A tubing string TS extends downwardly from a conventional wellhead W and mounts a flow controlling or choke mechanism CH above and adjacent to the perforations P of each of the vertically spaced production formations. Steam is supplied to the chokes CH through a supply line SL which leads to a source of high-temperature, high-pressure steam supplied from a pump PP. A valve V is provided to control the supply of steam to supply line SL. At a point in the supply line SL adjacent to the wellhead W, a different type of flow controlling or choke device CH-1 is mounted in series relationship.

The surface choke CH1 and each of the downhole chokes CH are proportioned to accelerate the flow of high-temperature steam to sonic level to assure that the steam is flowing through the choke at its critical mass flow rate; i.e., at the fastest rate permitted at the geometry of the constricted flow passages. At the same time, the choke devices CH and CH1 are designed with flared pressure recovery sections to produce a minimum pressure drop across such devices, so that the maximum pressure required from the steam source (not shown) will be significantly below the pressure required to supply a flow of steam to the various production formations at critical mass flow rate without employment of the chokes CH and CH1 embodying this invention.

Figure 2:
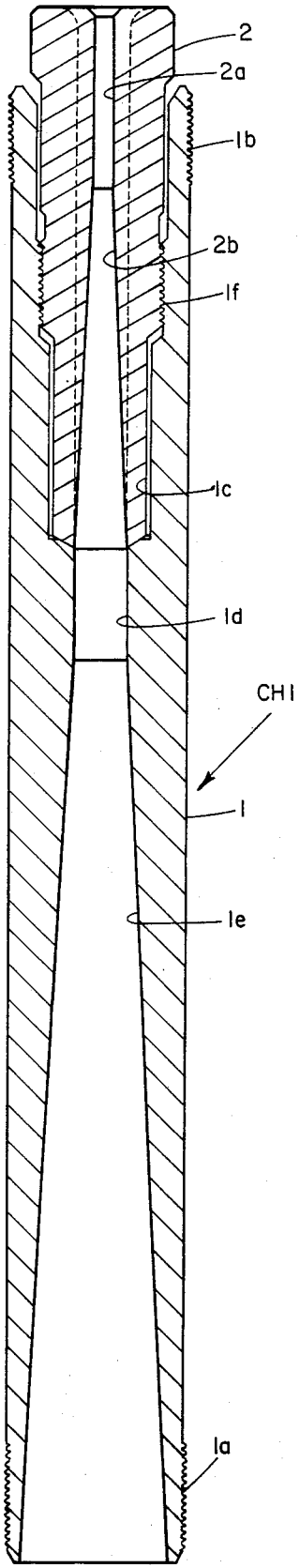
FIG. 2 is a sectional view of the Venturi device used in the aboveground steam supply system to achieve the desired mass flow rate of the steam into the well.

Referring to FIG. 2, there is shown the detailed construction of the choke CH1 which is utilized in the surface supply line SL. Such choke comprises an outer tubular member 1 having external threads 1*a* formed on its downstream end and external threads 1*b* formed on its upstream end. The discharge portion of the Venturi passage is defined within the bore of the outer tubular member 1 and comprises a cylindrical entry chamber 1*d* which is connected to a radially outwardly flaring expansion chamber 1*e*. Above the cylindrical chamber 1*d*as viewed in FIG. 2, the interior of the tubular member 1 is provided with an enlarged counterbore 1*c* which is further enlarged to define internal threads 1*f*. A tubular plug 2 is inserted in the counterbore 1*c* and has external threads engagable with the internal threads 1*f*. Plug 2 defines a constricted bore having a sharply reduced diameter portion 2*a* communicating with an expanding portion 2*b* which expands to the same diameter as the cylindrical portion 1*d* and communicates with the upstream end of cylindrical portion 1*d*. The reduced diameter portion 2*a* is proportioned to provide a desired mass flow rate of steam to the well.

The tubular housing 1 is connected in series relationship in the supply line SL by virtue of the external threads 1*a* and 1*b* respectively provided at its opposite ends. The plug element 2 defining the constricted bore 2*a* is preferably made as a separate piece, rather than formed integrally with the hollow tubular element 1 in order to permit convenient substitution of other plugs having greater or lesser constricted bore portions 2*a*.

Figure 3A:
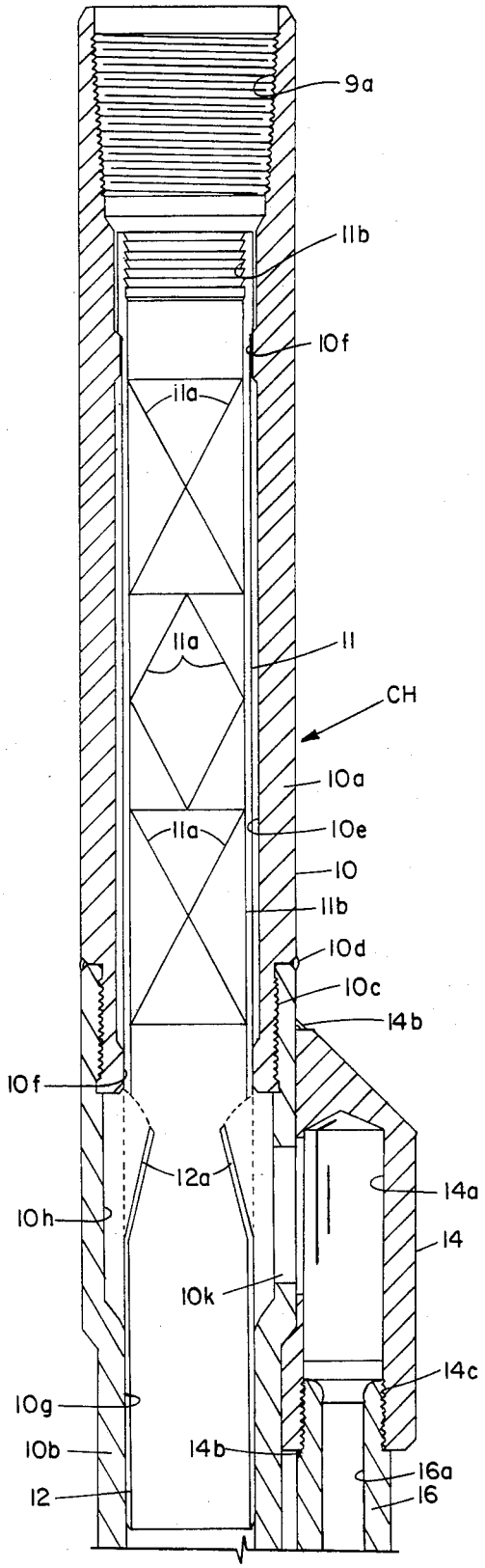
FIGS. 3A and 3B collectively represent a vertical sectional view of a choke apparatus employed in a single tubing string for injecting steam at a selected mass flow rate into a production formation located adjacent to its position in the tubing string.
Figure 3B:
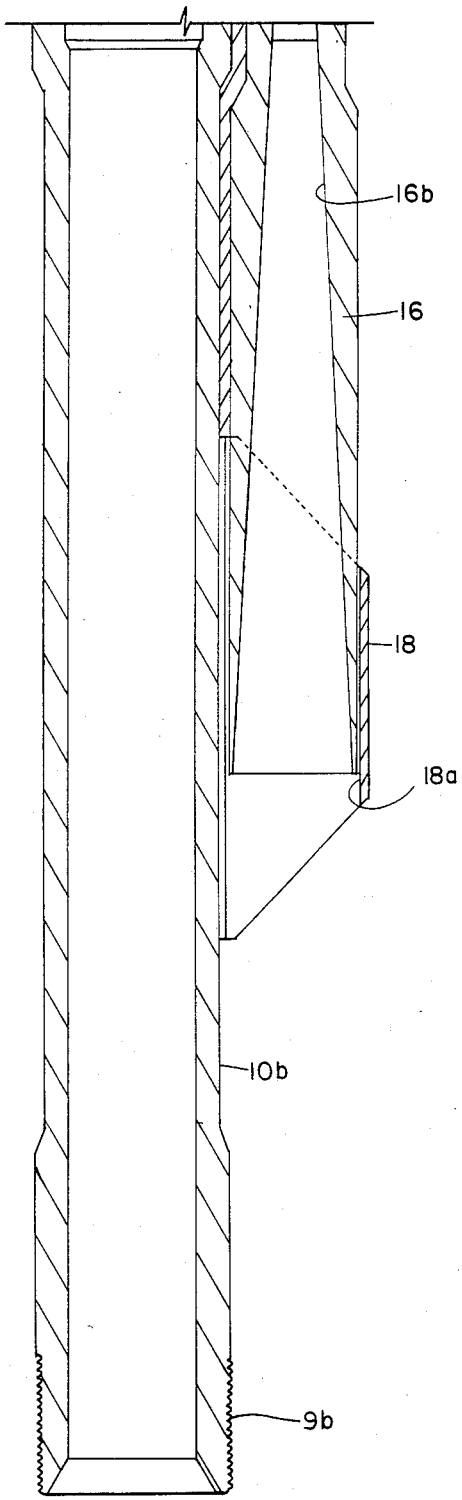

Referring now to FIGS. 3A and 3B, there is shown the detailed construction of the chokes CH which are serially inserted in the tubing string TS adjacent to and above the various production zones F1 and F2 into which the high-temperature steam is to be injected. Each choke CH comprises a generally cylindrical tubular housing assemblage 10 including an upper section 10*a* and a lower section 10*b* which are interconnected by threads 10*c* and rigidly secured together by a peripheral weld 10*d*. Threads 9*a* and 9*b* are respectively provided at opposite ends of housing assemblage to permit the insertion of choke CH in tubing string TS. Within the bore 10*e* of the upper tubular section 10*a*, a conventional fluid mixing device 11 is mounted as by having its cylindrical extension 12 lightly press-fitted within the bore 10*g* of lower section 10*b*. The turbulence inducer or static mixer 11 is a standard commercial item comprising a plurality of angularly disposed fixed blades 11*a* (shown only schematically) which operate on the steam flowing through the device to intimately mix the vapor and the water droplet components of the steam. Thus, a thoroughly mixed homogeneous mixture of liquid and vapor is discharged from the lower end of the static mixer 11 into the bore of the extension tube 12 which may comprise an integral extension of the outer tubular portion of the static mixer device 11. The static mixer device 11 may, for example, comprise a device sold under the trademark "KOMAX TRIPLE ACTION MOTIONLESS MIXERS" by Komax Systems, Inc. of Long Beach, Calif.

At peripherally spaced locations around the top portions of the tube 12, the walls of the tube are slit and depressed inwardly to form deflecting tabs 12*a*. The function of these tabs is to divert a portion of the outer periphery of the homogeneous flow of steam and water outwardly against the inner walls of an enlarged internal bore portion 10*h* formed in the lower tubular housing section 10*b*. An axially elongated slot 10*k* is formed in the wall of enlarged bore portion 10*h* to direct the diverted portion of the steam into a generally cylindrical inlet chamber 14*a* defined in a secondary housing 14 which is welded as at 14*b* to the perimeter of the lower tubular housing section 10*b*. The lower portion of the bore 14*a* of the secondary housing 14 is provided with internal threads 14*c*. A hollow plug 16 is provided with external threads which cooperate with internal threads 14*c*. The plug 16 defines a Venturi passage having a generally cylindrical constricted portion 16*a* communicating with an outwardly flared portion 16*b* from which the diverted steam is discharged at a selected mass flow rate, determined by the configuration of the Venturi passage. A protective guide 18 is welded to the outer periphery of the lower tubing section 10*b* and defines a hollow bore 18*a* which receives the lower end of the plug 16.

By reference to FIG. 3A, it will be seen that the diverted steam discharged at selected mass flow rate from the Venturi passageway 16*a* will flow through flared portion 16*b*, through the casing perforations P into the production formation which is immediately adjacent and below the discharge end of the Venturi passage 16*b*. To prevent loss of steam down the casing, a packer PR is preferably provided immediately below each set of perforations to be treated.

The utilization of a separate replaceable plug element 16 to define the Venturi discharge passage 16*b* has the obvious advantage of permitting the ready adjustment of the size of the Venturi to attain the acceleration of the diverted portion of steam to its critical mass flow rate.

The employment of the static mixer 11 is not essential to the operation of the apparatus of this invention but it represents a preferred embodiment of the invention. In the construction shown in FIG. 3A, the static mixer 11 may be removed by a wireline tool through engagement with internal ratchet-shaped threads 11*b* provided at the upper end of the static mixer 11.

There are some applications wherein it is deemed desirable to effect the wireline removal of both the static mixer and the Venturi passageway from the tubing string. The modification of this invention shown in FIGS. 4A and 4B permits the wireline retrieval of such elements from the tubing string. The choke device CH 2 shown in FIGS. 4A and 4B comprises an outer tubular housing 20 assembly which is provided with internal threads 20*a* at its upward end and external threads 20*b* at its lower end to permit the series insertion of the housing assembly 20 in the tubing string TS. Housing assembly 20 actually comprises the welded assemblage of a plurality of components. Thus, an upper connecting housing 20*c* is welded to an annular connecting block 22 by a peripheral weld 20*d*. An intermediate tubular section 20*e* is also welded to the connecting block 22 by a peripheral weld 20*f*. The lower end of intermediate tubular section 20*e* is secured by a peripheral weld 20*g* to a bottom connecting sub 24. To facilitate the fabrication of welds 20*d*, 20*f* and 20*g*, the respective parts secured by such welds are also secured by cooperating threads.

A static mixing device 11 of the same type employed in the modification of 3A is then snugly fitted within the bore 22*d* of the annular connecting block 22. Static mixing device 11 is provided with an integral, downwardly extending tubular extension 12 which has its wall slit at peripherally spaced intervals to permit guide portions 12*a* to be inwardly deflected to divert a portion of the homogeneous steam and water mixture issuing from the static mixer 11 outwardly to flow downwardly through the annulus 15 defined between the outer wall of the extension portion 12 and the inner wall of the tubular element 20*e* of outer housing 20.

In this modification, the inner portion of the steam flow issuing from the static mixer 11 is directed to the production formation. The lower portion of the diversion tube 12 has a connecting bushing 13 secured thereto by a peripheral weld 13*a*. Bushing 13 is provided with internal threads at its lower end to threadably mount the upper end of a Venturi defining plug 14. Plug 14 defines an inwardly tapering entrance section 14*a*, a constricted cylindrical section 14*b*, and an outwardly flaring expansion portion 14*c*. The lower end of Venturi plug 14 is provided with external threads 14*d* which receive the top end of an internally threaded sleeve 16 which is lightly press-fitted within the bore 18*a* of a porting structure 18.

Porting structure 18 defines an internal annular fluid passage 18*b* which surrounds a plurality of peripherally spaced ports 16*a* formed in the sleeve 16. Annular passage 18*b* is in turn connected by a plurality of peripherally spaced ports 18*c* to ports 20*a* formed in the wall of the tubular portion 20*e* of the outer housing 20. Rings 19 are respectively welded to the port defining element 18 and the tubular element 20*e* in aligned relationship with the ports 18*c* and 20*k* to complete a plurality of radially extending fluid passages or pipes for the steam to be injected into the annulus between the housing 20 and the interior bore of the casing C for entry into the production formations through perforations P.

Thus, inner portions of the steam flow discharged from the static mixer 11 is directed to the Venturi inlet and the outer portions of the steam flow discharged from the static mixer proceed downstream to the next choke device.

The improved efficiency of the aforedescribed apparatus for supplying, at selected mass flow rates, steam to a plurality of production zones through a single conduit may readily be calculated. Take, for example, a conventional single-pipe system for supplying two vertically separated production formations. The apparatus conventionally used comprises a radial orifice connecting the interior of the pipe to each production formation. To maintain the desired mass flow rates with such a system, assuming a predetermined length of tubing string and separation of the production zones, requires a source of steam at 950 psi and 538° F. In contrast, utilizing the same assumed well configuration but employing the Venturi choke system of the type disclosed in FIGS. 3A and 3B requires steam at only 550 psi and 477° F. to maintain the desired mass flow rate of steam supplied to each of the production formations. Obviously, the cost of the steam boiler and associated equipment, and the operation of such would be substantially reduced due to the substantial reduction in pressure requirement.

Figure 4A:
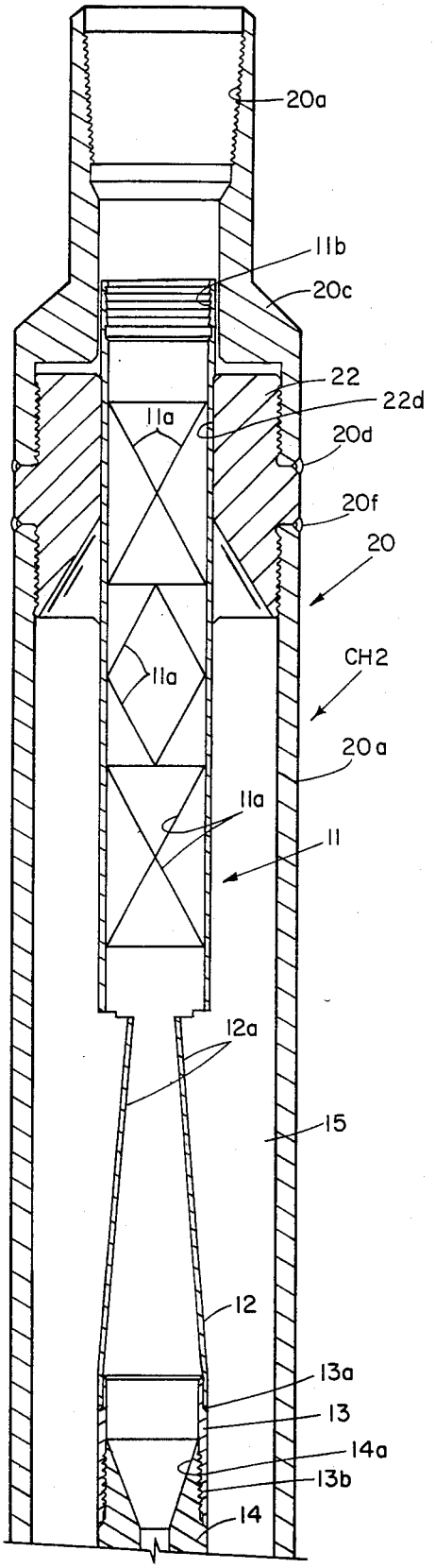
FIGS. 4A and 4B collectively represent a vertical sectional view of a modified form of choke apparatus for injecting steam into an adjacent production formation, characterized in that the injection choke is removable by wireline.
Figure 4B:
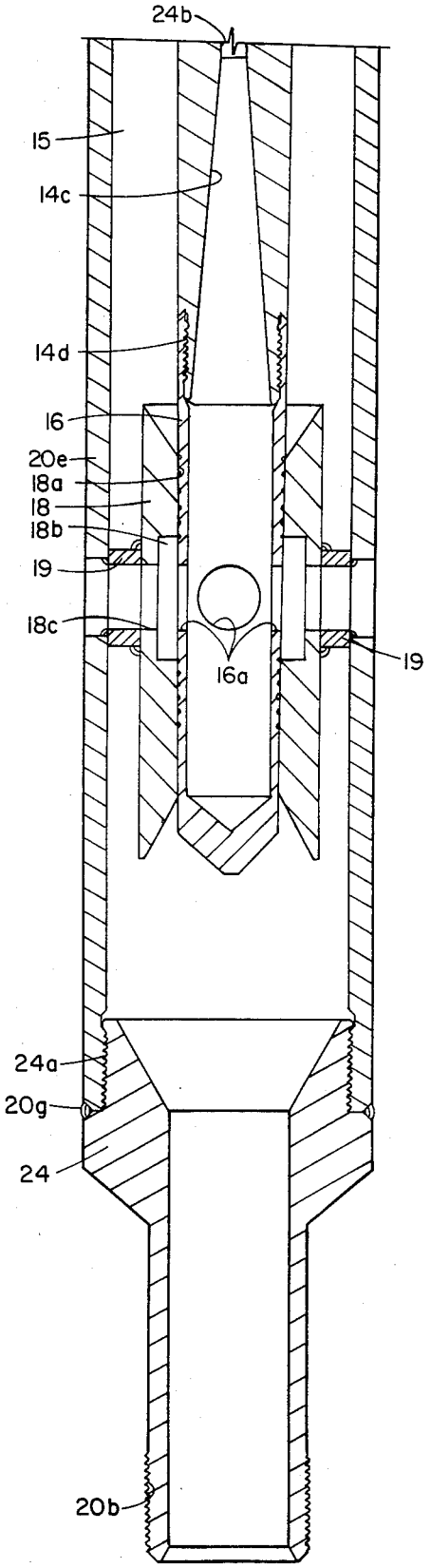

The fundamental reason for such a significant pressure reduction is believed to reside first in the efficient separation of the downward flow of steam into two radially spaced portions, one portion being directed to the Venturi choke while the other portion continues to flow downwardly, and secondly, in the pressure recovery accomplished by the flared portions of the Venturi passages. As pointed out above, in the modification of FIGS. 3A and 3B, the radially outer portion of the downwardly directed steam flow is diverted into the inlet chamber of a Venturi flow passage which accelerates the diverted portion to critical mass flow rate prior to discharging same into the production zone. In the modification of FIGS. 4A and 4B, the central portion of the downwardly flowing steam is directed into a Venturi for accelerating such portion to critical mass flow rate which is then directed radially outwardly into the production zone, while the outer portion of the steam flow continues without interruption in its downward flow to the next production formation. With either modification, an economically important reduction in the amount of pressure required to supply the steam flow to the production formation at a selected mass flow rate is accomplished.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A method of injecting steam at a selected mass flow rate into a production formation of a subterranean well having a tubing string traversing the production formation comprising the steps of:

supplying a steam flow to the surface end of the tubing string;

diverting the downwardly flowing steam into two radially separated flow components above and adjacent to the production formation;

directing one of said flow components into the inlet end of a Venturi passage, the outlet end of the Venturi passage being in communication with the production formation; and accelerating the flow rate of said one flow component by said Venturi passage to its critical mass flow rate.

2. The method of claim 1 wherein the radially outer steam flow component is directed to a Venturi flow passage disposed on the exterior of the tubing string.

3. The method of claim 1 wherein each radially outer steam flow component is directed to a respective Venturi flow passage disposed on the exterior of tubing string and each radially inner steam flow component continues down the tubing string to the next production formation.

4. The method of claim 4 wherein the radially inner steam flow component is directed through a Venturi flow passage disposed interiorly of the tubing string and then directed to the production formation by radial pipes traversing the wall of the tubing string

5. The method of claim 1 further comprising the step of homogeneously mixing the vapor and water components of the steam flow prior to effecting the separation of the steam flow into radially spaced components.

6. A method of injecting steam at selected mass flow rates into a plurality of vertically spaced production formations traversed by a single steam carrying tubing string, comprising the steps of:

supplying a steam flow to the surface end of the tubing string;

diverting the downwardly flowing steam into two radially separated flow components above and adjacent to each of the production formations;

directing one of each said two flow components into the inlet end of a Venturi passage, the outlet end of the Venturi passage being in communication with a respective production formation; and accelerating the flow rate of each said one flow component by said respective Venturi passage to its critical mass flow rate; and directing the other of each said flow components downwardly through the tubing string to the next lower production formation.

7. The method of claim 1 or 6 further comprising the step of supplying the steam at a selected mass flow rate to the surface end of the tubing string by passing the supplied steam through a Venturi passage.

8. The method of claim 6 wherein each radially inner steam flow component is directed to a respective Venturi flow passage disposed interiorly of the tubing string and then directed to the respective production formation by radial pipes traversing the wall of the tubing string, whereby the radially outer steam flow component continues down the tubing string to the next production formation.

9. The method of claim 6 further comprising the step of homogeneously mixing the vapor and water components of the steam flow prior to effecting each separation of the steam flow into radially spaced components.

10. Apparatus for injecting steam into a production formation of a subterranean well at a selected mass flow rate comprising a tubular housing connectable in series relationship to the tubing string adjacent the production formation; fluid diverting means in said tubular housing for dividing the steam flow into two radially separated components; and means including a Venturi passage for accelerating the flow rate of one said flow component to the critical mass flow rate and directing the accelerated component to the production formation.

11. Apparatus for injecting steam at selected mass flow rates into a plurality of vertically spaced production formations through a single tubing string traversing said formations comprising: a plurality of tubular housings connected in series relationship to the tubing string and respectively positioned adjacent said production formations; fluid diverting means in each said tubular housing adjacent each production formation for dividing the steam flow into two radially separated components; and means including a Venturi passage for accelerating the flow rate of one said flow component to its critical mass flow rate and directing the accelerated component to the respective production formation, whereby said other flow component flows downwardly to the next lower tubular housing.

12. The apparatus of claim 10 or 11 wherein said Venturi passage is disposed exteriorly of said tubular housing.

13. The apparatus of claim 10 or 11 wherein said Venturi passage is disposed in the interior of said tubular housing, and conduit means for directing the steam discharge from said Venturi passage outwardly through the wall of said tubular housing.

14. Apparatus for injecting steam at a selected mass flow rate into a production formation of a subterranean well from a tubing string extending to the surface comprising: a tubular housing connectable in series relationship to the tubing string adjacent the production formation; means in said tubular housing for diverting a portion of the steam flow down the tubing string to the outer peripheral wall of said tubular housing; said outer peripheral wall having a port opening therethrough; a secondary housing secured to the said exterior of tubular housing adjacent said port opening, said secondary housing defining an inlet chamber communicating with said port opening; and a downwardly directed Venturi passageway to discharge a portion of the high-velocity steam flow into an adjacent production formation.

15. The apparatus of claims 10, 11, or 14 wherein each said Venturi passage is proportioned to accelerate the steam to critical mass flow rate to deliver steam to the adjacent production formation at a selected mass flow rate.

16. The apparatus of claims 10, 11, or 14 further comprising stationary fluid mixing means disposed in the upper portion of said tubular housing above said fluid diverting means for producing a homogeneous mixture of steam vapor and liquid.

17. The apparatus of claim 14 wherein said secondary housing comprises a first member welded to the exterior of said housing and defining said inlet chamber, and a second tubular member defining said Venturi passageway; and means for threadably securing said second tubular member to the bottom of said first member.

18. The apparatus of claims 10, 11, or 14 further comprising fluid mixing means disposed in said tubular housing above each said fluid diverting means for producing a homogeneous mixture of steam vapor and liquid, and wherein said diverting means is secured to said fluid mixing means; and means on said fluid mixing means engagable by wireline to permit removal and replacement of said fluid mixing means and said fluid diverting means.

19. The apparatus of claims 10, 11, or 14 wherein said fluid diverting means comprises a tube snugly inserted in the bore of said hollow housing, said tube having a plurality of peripherally spaced side wall cutouts deformed inwardly relative to the bore of said tube.

20. Apparatus for injecting steam at a selected mass flow rate into a production formation of a subterranean well comprising: a wellhead connected to a tubing string extending into the well to a production formation; a source of high-pressure steam; a conduit connecting said source to said wellhead; means in said conduit defining a Venturi passage for the steam to accelerate same to its critical mass flow fate; a tubular housing connectable in series relationship to the tubing string adjacent the production formation; fluid diverting means in said tubular housing for dividing the steam flow into two radially separated components; and means including a Venturi passage for accelerating the flow rate of one said flow component and directing the accelerated component to the production formation.

21. Apparatus for injecting steam at selected mass flow rates into a plurality of vertically spaced production formations of a subterranean well comprising: a wellhead connected to a tubing string extending into the well to said production formations; a source of high-pressure steam; a conduit connecting said source to said wellhead; means in said conduit defining a Venturi passage for the steam to accelerate same to its critical mass flow rate; a plurality of tubular housings connected in series relationship to the tubing string and respectively positioned adjacent said production formations; fluid diverting means in each said tubular housing for dividing the steam flow into two radially separated components; and means including a Venturi passage for accelerating the flow rate of one said flow component and directing the accelerated component to the respective production formation, whereby said other flow component flows downwardly to the next lower tubular housing.

22. Apparatus for injecting steam at a selected mass flow rate into a production formation of a subterranean well comprising: a wellhead connected to a tubing string extending into the well to a production formation; a source of high-pressure steam; a conduit connecting said source to said wellhead; means in said conduit defining a Venturi passage for the steam to accelerate same to its critical mass flow rate; a tubular housing connectable in series relationship to the tubing string; means in said tubular housing for diverting a portion of the steam flow down the tubing string to the outer peripheral wall of said tubular housing; said outer peripheral having a port opening therethrough; a secondary housing secured to the exterior of said tubular housing adjacent said port opening, said secondary housing defining an inlet chamber communicating with said port opening and a downwardly directed Venturi passageway to discharge a portion of the steam flow into an adjacent production formation.

23. The apparatus of claims 20, 21, or 22 wherein each said Venturi passage is proportioned to deliver steam to the adjacent production formation at a selected mass flow rate.

24. The apparatus of claims 20, 21, or 22 further comprising stationary fluid mixing means disposed in the upper portion of each said tubular housing above said fluid diverting means for producing a homogeneous mixture of steam vapor and liquid.

* * * * *